United States Patent [19]

Paulus

[11] Patent Number: 4,785,881

[45] Date of Patent: Nov. 22, 1988

[54] PLASTIC WELL WITH PLASTIC WELL ADAPTER

[76] Inventor: Cecil H. Paulus, Rte. 2, Box 495, Leesburg, Ind. 46538

[21] Appl. No.: 39,942

[22] Filed: Apr. 20, 1987

[51] Int. Cl.[4] ..... E21B 33/03

[52] U.S. Cl. ..... 166/88; 166/85

[58] Field of Search ..... 166/88, 89, 82, 83, 166/85, 100, 114, 139, 902, 242, 92-94

[56] References Cited

U.S. PATENT DOCUMENTS

| | | | |
|---|---|---|---|
| 2,931,379 | 4/1960 | Haydin | 166/88 |
| 3,055,424 | 9/1962 | Allen | 166/242 |
| 3,270,818 | 9/1966 | Pugh, Jr. | 166/88 |
| 3,403,730 | 10/1968 | Williams | 166/88 |
| 3,556,213 | 1/1971 | Kramer | 166/88 |
| 3,563,310 | 2/1971 | Wellstein | 166/89 X |
| 3,722,586 | 3/1973 | Baker | 166/89 |
| 4,056,144 | 11/1977 | Wellstein | 166/88 X |
| 4,226,286 | 10/1980 | Cramer | 166/88 X |

*Primary Examiner*—Jerome Massie, IV
*Assistant Examiner*—Bruce M. Kisliuk
*Attorney, Agent, or Firm*—Wendell E. Miller

[57] ABSTRACT

A plastic well (10) includes a plastic well casing (12) with a hole (16) that is disposed transversely to a casing axis (14). A plastic adapter plug assembly (38) is disposed inside the casing (12) and is forced toward the transversely-disposed hole (16) in the casing (12) by a plastic locking cam (58) that is a part of the adapter plug assembly (38). The adapter plug assembly (38) is supported by a plastic support plate (26) that engages the top (28) of the casing (12), and by a plastic support tube (32) that is bonded to both the support plate (26) and the adapter plug assembly (38). A plastic saddle (18) is disposed outside the casing (12) and is bonded over the hole (16) in the casing (12).

25 Claims, 5 Drawing Sheets

PLASTIC WELL WITH PLASTIC WELL ADAPTER

BACKGROUND OF THE INVENTION

1. Field of the Invention

The present invention relates to an adapter for connecting a well pipe inside a well casing to a hole that is transversely disposed through a hole in the well casing, and connecting to the transversely-disposed hole external to the casing. More particularly, the present invention relates to a well made of plastic parts, and to both apparatus and method for removably clamping a plastic adapter plug assembly against the inside of a plastic well casing.

2. Description of the Related Art

Cramer, U.S. Pat. No. 4,226,286, provides a well adapter which includes means for forcing an adapter plug transversely against a seal that is disposed between the adapter plug and a transversely-disposed hole in the well casing. The adapter plug includes a sector-shaped member that is retained in an arcuately-shaped track by forming both the sector-shaped member and the arcuately-shaped track with inclined faces.

Rubber balls are used as friction members to prevent gravity, or other forces, from moving the arcuately-shaped member downward and out into contact with the casing accidentially. A screw member is disposed parallel to the casing axis to provide a locking force that presses the arcuately-shaped member downwardly, around the arcuately-shaped track, and outwardly against the casing, thereby compressing a resilient seal that is disposed diametrically across from the arcuately-shaped member.

The adapter plug is maintained in a correct vertical relationship with the hole in the casing by means of a hook that extends outwardly from the adapter plug and that engages the hole in the casing.

Pugh, Jr., U.S. Pat. No. 3,270,818 provides a well adapter in which a vertically-disposed draw bolt pulls a wedge-shaped expansion block upwardly, forcing another wedge-shaped expansion block outwardly, and forcing another member into engagement with the well casing.

The clamping force against the casing wall is used for clamping the adapter plug in a fixed vertical position in the well casing and for forcing the adapter plug transversely against a resilient seal.

Williams, U.S. Pat. No. 3,403,730, provides a well adapter in which the adapter plug is forced transversely against a resilient seal and a hole in the side of the casing by a wedge that is disposed diametrically across from the resilient seal and the hole in the casing.

SUMMARY OF THE INVENTION

In the present invention, a plastic well is provided which includes a plastic well casing, a plastic saddle that is attached to the outside of a casing and that communicates with a transversely-disposed hole in the casing, a plastic support plate that has a closable opening and that rests on the top of the casing, a plastic support tube that is bonded to the support plate, and a plastic adapter plug assembly that is bonded to the support tube.

The adapter plug assmebly includes a plastic plug body having a cylindrically-shaped surface that is disposed around a longitudinally-disposed casing axis, having an outlet port in the cylindrically-shaped surface, having a sealing-ring groove that is disposed circumferentially around the outlet port, having a top surface, and having a bottom surface with an inlet port that communicates with the outlet port.

A resilient seal is disposed in the sealing-ring groove and is bonded into the groove with an adhesive; so that the resilient seal remains in place while the adapter plug is placed into the wall casing.

The adapter plug assembly is provided with locking means for forcing the plug body toward the hole in the casing, for pressing the resilient seal into sealing engagement between the cylindrically-shaped surface of the plug body and the casing, and for locking the adapter plug into the desired vertical and rotational position in the casing.

The locking means includes both a recess in the plug body and a plastic locking cam. Both the recess and the cam include an arcuately-shaped surface; and the arcuately-shaped surface guide the cam in movement around a pivot axis and into locking engagement with the casing as an adjusting screw puts a downward force onto the cam.

The plug body includes a pin-receiving recess that is disposed coaxially with the pivot axis on the cam, another pin-receiving recess in the cam, and a retaining pin that engages both of the pin-receiving recesses.

Preferably, the pin-receiving recesses are cylindrically-shaped holes; and preferably, one of the pin receiving-recesses is oversized in relation to the diameter of the retaining pin. By being oversized, the one pin-receiving recess allows the retaining pin and the pin-retaining recesses to be a retaining means for the cam without any bearing stress being placed on the pin-receiving holes as the cam slides around the arcuately-shaped surface in the recess of the plug body, even if the sliding movement of the cam is not exactly on the pivot axis of the retaining pin.

Avoiding bearing stress in the pin-receiving holes is important to one of the primary objectives of the invention, that is, being able to form both the plug body and the cam from a plastic material.

The adjusting screw, the support tube, and the opening in the support plate are all coaxial with the casing axis; so that access to the adjusting screw is achieved without the necessity of exposing the well to the danger of knocking dirt down into the well, and without the danger of dropping a wrench down into the well.

When the well adapter is locked into the well with the adapter tube, the support tube holds the support plate down over the top of the casing; and so there is no way for children to drop dirt or rocks into the casing without first removing a threaded plug from the access opening in the support plate, loosening the adjusting screw, and pulling the support plate, adapter plug, and entire well pipe and pump upwardly.

Thus the present invention prevents accidental contamination of the well, and contamination by vandalism. A common problem is that children will drop rocks into the well to hear them splash in the water, and that the rocks will wedge between the submersible pump and the well casing, making it extremely difficult to remove the pump from the casing.

It is a primary object of the present invention to provide a well assembly in which long life and freedom from corrosion are achieved by eliminating the use of corrosive metal parts.

It is an object of the present invention to provide a well adapter in which primary parts, such as the adapter plug, locking element for the adapter plug, support plate, and saddle are formed from plastic materials, thereby avoiding both problems with corrosion and the high cost of non-corrosive metallic materials.

It is an object of the present invention to provide a well adapter in which a locking cam slides around a pilot axis on an arcuately-shaped surface, and rotation of the cam is around a pivot axis.

It is an object of the present invention to provide a well adapter in which the cam is retained by a pin and two pin-receiving holes, and one of the pin-receiving holes is oversized, thereby substantially eliminating bearing stresses on the pin-receiving holes and allowing the use of plastic parts.

It is an object of the present invention to provide a well adapter in which a support plate is secured to the adapter plug; so that clamping the adapter plug against the side of the well casing locks the support plate to the top of the well casing, greatly reducing the opportunity for tampering with the well.

It is an object of the present invention to provide a well adapter in which access to the locking means for the adapter plug is through a closable access opening in the support plate and a support tube that are both insolated from the remainder of the well, thereby preventing either contamination of the well through the opening in the support plate or dropping of a wrench into the well while attempting to lock the adapter plug with the adjusting screw.

It is an object of the present invention to provide a support plate assembly for a well in which the support plate is molded from plastic, an air-tight seal is provided between the well casing and the support plate assembly, and means is provided for converting the support plate assembly from an air-tight device to an air-breathing device.

Other objects of the invention will become obvious from the drawings and detailed description that are included herein.

DESCRIPTION OF THE PREFERRED EMBODIMENTS

Figure 1:
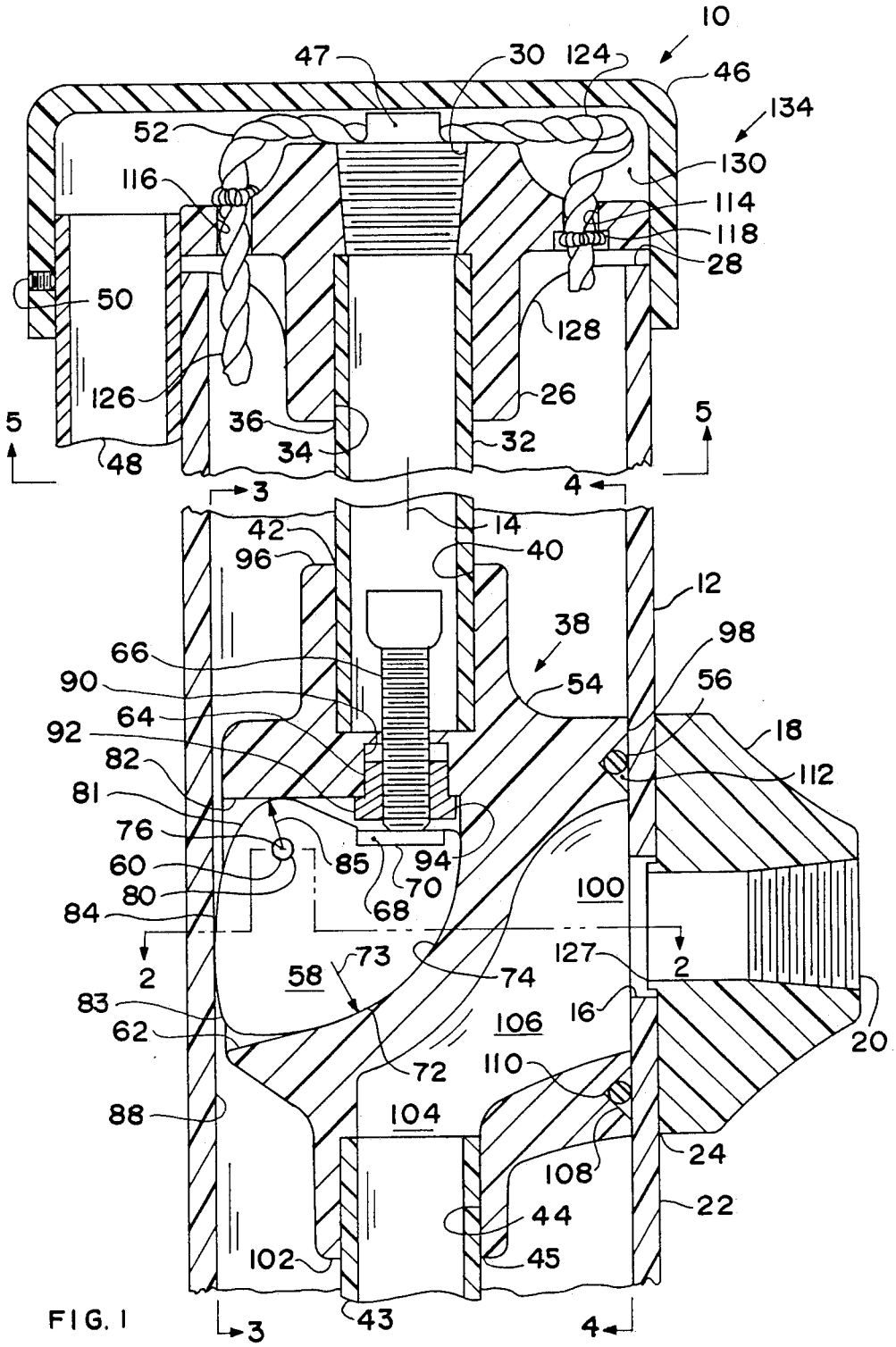
FIG. 1 is a cross-sectional elevation of a preferred embodiment of the present invention with the portion above the break lines rotated ninety degrees around the casing axis from the portion below the break lines.

Referring now to the drawings, and more particularly to FIG. 1, a plastic well assembly 10 includes a plastic well casing 12 having a longitudinally-disposed casing axis 14 and a transversely-disposed hole 16, and a plastic saddle 18 having a threaded port 20 and being bonded to a cylindrically-shaped outside surface 22 of the casing 12 by a bonded joint 24.

Figure 4:
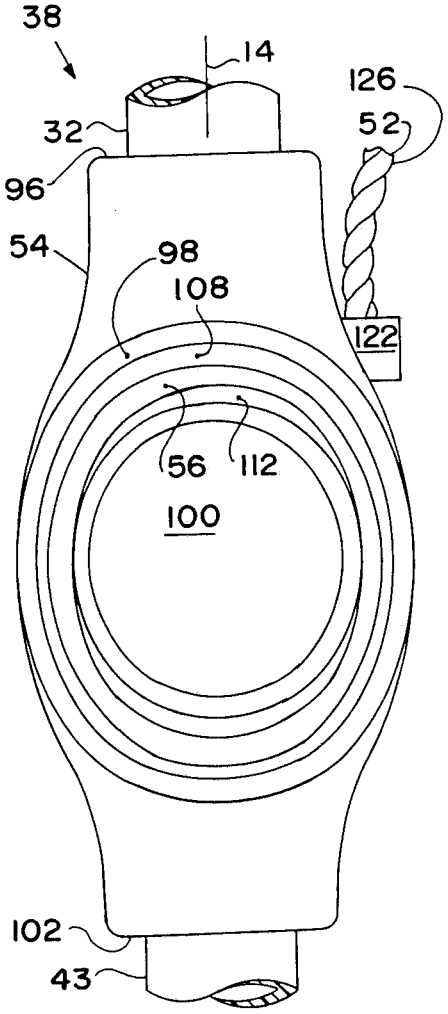
FIG. 4 is the opposite side view of the adapter plug assembly of FIG. 1, taken substantially as shown by view line 4—4 of FIG. 1.

Referring now to FIGS. 1 and 4, the plastic well assembly 10 includes, a plastic support plate 26 being supported by a top 28 of the casing 12 and having a threaded access opening 30 that is disposed coaxially with the casing axis 14, a plastic support tube 32 that is bonded in a socket 34 in the support plate 26 by a bonded joint 36, a plastic adapter plug assembly 38 that is bonded to the support tube 32 by means of a socket 40 and a bonded joint 42.

Referring again to FIG. 1, the plastic well assembly 10 includes a plastic well pipe 43 that is attached to the adapter plug assembly 38 by means of a socket 44 and a bonded joint 45, a plastic well cap 46 that rests on a threaded plastic plug 47 in the access opening 30 of the support plate 26, a plastic electrical conduit 48, a set screw 50 that clamps the electrical conduit 48 between the well cap 46 and the support plate 26 and that secures the well cap 46 to the support plate 26, and a rope 52.

Referring again to FIGS. 1-4, the adapter plug assembly 38 includes a plastic plug body 54, a sealing ring, or O-ring, 56, a plastic locking element, or plastic locking cam, 58, a retaining pin 60 that retains the locking cam 58 in a recess 62 in the plug body 54, a threaded metal bushing 64, a threaded adjusting screw 66, and a metallic bearing plate 68 that is bonded to the locking cam 58 by a bonded joint 70.

The locking cam 58 includes an arcuately-shaped surface 72 that has a radius 73; and the recess 62 in the plug body 54 includes an arcuately-shaped surface 74 that conforms to the arcuately-shaped surface 72 and that guides the locking cam 58 in motion around a pivot axis 76 as the adjusting screw 66 is screwed downwardly against the metallic bearing plate 68.

Figure 2:
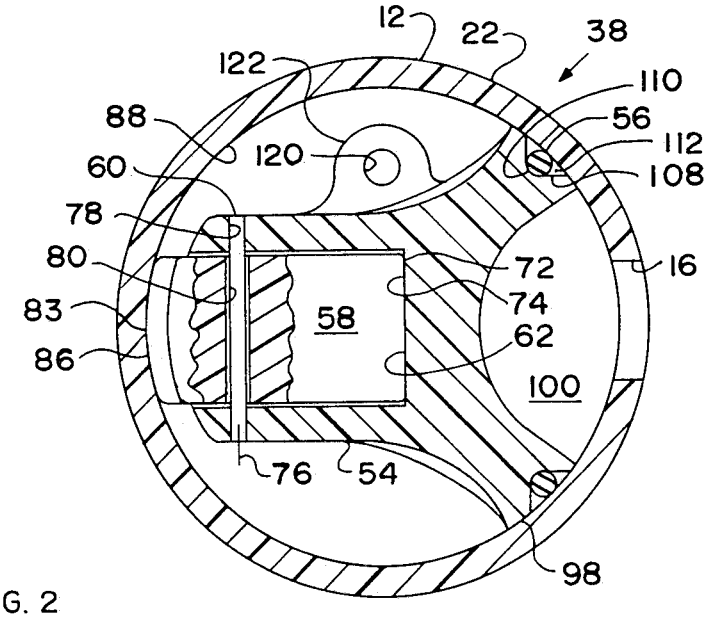
FIG. 2 is a cross-section of the portion of FIG. 1 that is below the break lines, taken substantially as shown by section line 2—2 of FIG. 1.

The plug body 54 includes a pair of pin-receiving openings, or holes, 78 which are coaxial with the pivot axis 76; and the locking cam 58 includes a pin-receiving opening, or hole, 80. Either the pin-receiving openings 78 are significantly larger in diameter than the retaining pin 60, or the pin-receiving opening 80 is significantly larger in diameter than the retaining pin 60; so that the locking cam 58 can be forced to slide around the arcuately-shaped surface 74 without placing any shear stress in the retaining pin 60, and without placing any bearing load on the pin-receiving openings 78 or 80. Preferably, the pin-receiving opening 80 is oversized, as shown in FIGS. 1 and 2.

The locking cam 58 includes a second arcuately-shaped surface 81 that is coaxial with the pivot axis 76, that has a radius 85, and that remains in close proximity to a restraining surface 82 in the recess 62 as the locking cam 58 is rotated around the pivot axis 76. Thus, the second arcuately-shaped surface 81 and the restraining surface 82 cooperate with the oversizing of the pin-receiving opening 80 to provide means for preventing the locking cam 58 from moving upwardly, and thus cooperate with the arcuately-shaped surfaces 72 and 74 in providing a means for preventing forces between the well casing 12 and the locking cam 58 from applying a stress on either of the pin-receiving openings, 78 or 80, or on the retaining pin 60. As can be seen by inspecting FIG. 1, the radius 85 of the arcuately-shaped surface 81 is less than one-half of the radius 73.

The locking cam 58 includes a camming surface 83 that is bowed away from the casing axis 14 by a curvature 84, as seen in FIG. 1, and a curvature 86 that generally conforms the locking cam to an inside surface 88 of the casing 12. The curvatures 84 and 86 prevent marring of the inside surface 88 of the casing 12 and, more importantly, prevent excess compressive stresses on the locking cam 58.

The threaded metal bushing 64 is pressed into a hole 90 in the plug body 54, includes a retaining flange 92, and includes a flat 94 on the retaining flange 92. The flat 94 obviates any possibility of the bushing 64 rotating in the hole 90.

Referring now to FIGS. 1, 2 and 4, the plug body 54 includes a top 96, a cylindrically-shaped surface 98 that is coaxial with the casing axis 14 and that includes an elliptically-shaped outlet port 100, a bottom 102 that includes an inlet port 104, and a fluid passage 106 that communciates the inlet port 104 to the outlet port 100.

The plug body 54 also includes an elliptically-shaped sealing ring groove 108. The sealing ring groove 108 includes a cross sectional shape that is a rounded-bottom vee 110. The rounded-bottom vee 110 provides a conforming surface for bonding the O-ring 56, and a clearance volume 112 for receiving excess volume for the O-ring 56 at it is compressed between the groove 108 and the inside surface 88 of the casing 12.

Referring again to FIG. 1, the threaded access opening 30, the socket 34, the support tube 32, the socket 40, the threaded metal bushing 64, and the adjusting screw 66, are all generally coaxial with the casing axis 14. As seen in FIG. 1, access to the adjusting screw 66 is by means of the threaded access opening 30 and the support tube 32; so there is no danger of dropping a wrench into the well when tightening or loosening the adjusting screw 66, nor is there any danger of knocking dirt into the well during these tightening or loosening operations.

Figure 5:
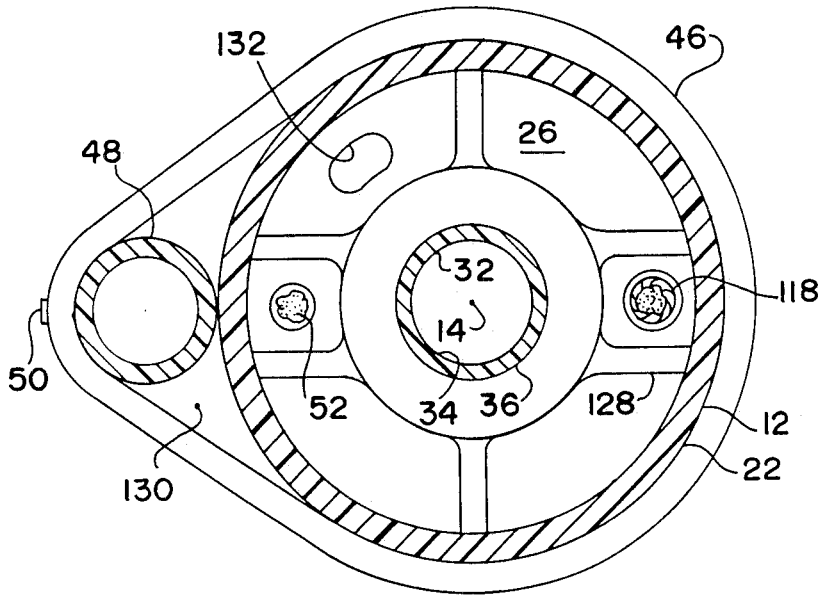
FIG. 5 is a cross-section of the portion of FIG. 1 that is above the break lines, taken substantially as shown by section line 5—5 of FIG. 1.
Figure 3:
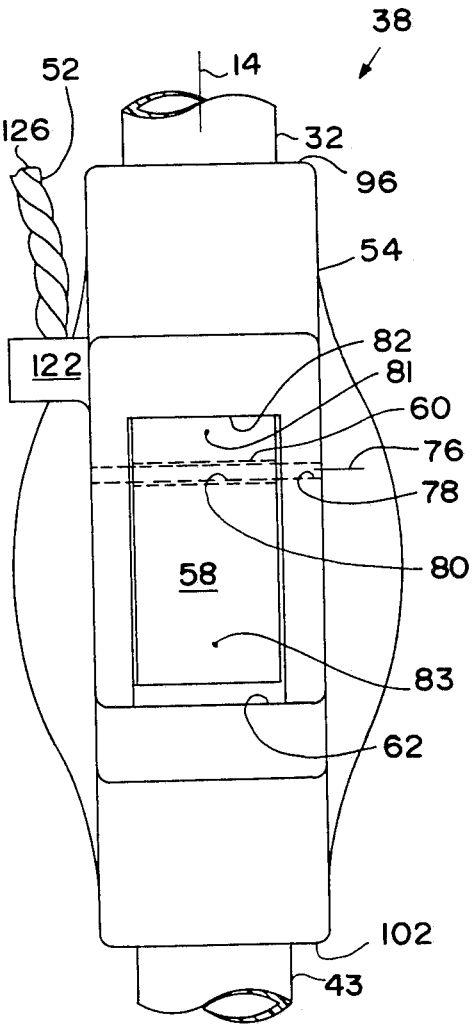
FIG. 3 is one side view of the adapter plug assembly of the embodiment of FIG. 1, taken substantially as shown by view line 3—3 of FIG. 1.

Referring now to FIGS. 1, 3, and 5, the rope 52 is inserted through holes 114 and 116 in the support plate 26, and is retained in the hole 114 by a knot, or retainer, 118. The rope descends downward from the hole 116, and is secured to the plug body 54 by means of a hole 120 in a lug 122 that extends outwardly from the plug body 54. The rope 52 includes a handle portion 124 that is disposed between the holes 114 and 116 that provides a handle means for removing the support plate 26, and parts attached thereto, from the casing 12. The rope 52 also includes a safety portion 126 that is disposed between the support plate 26 and the adapter plug assembly 38, and that provides safety against dropping the adapter plug assembly 38, and parts descending therefrom, down into the casing 12.

In operation, the plastic well 10 is assembled as described above, and in addition, a submersible pump (not shown) is attached to the well pipe 43. The submersible pump is lowered into the well casing 12, lengths of the well pipe 43 are bonded together, the adapter plug assembly 38 is bonded to the well pipe 43, the support tube 32 is cut to the correct length to vertically align the adapter plug assembly 38 with the transversely-disposed hole 16 in the casing 12, the support tube 32 is bonded to the adapter plug assembly 38, the support plate 26 is bonded to the support tube 32 in a predetermined rotational relationship with respect to the adapter plug assembly 38, the support plate 26 and the adapter plug assembly 38, with attached parts descending therefrom, are rotationally positioned to align the O-ring 56 around the hole 16 in the casing 12, the support plate 26 is rested onto the top 28 of the casing 12, and the adjusting screw 66 is tightened downward against the metallic bearing plate 68, forcing the locking cam 58 downward and outward around the arcuately-shaped surface 74, thereby forcing the adapter plug assembly 38 toward the hole 16 and compressing the O-ring 56 between the plug body 54 and the well casing 12, and forcing the surface 83 of the locking cam 58 into locking engagment with the inside surface 88 of the casing 12.

The plastic saddle 18 includes a pilot portion 127 which extends into the hole 16 of the well casing 12 and a part of the way therethrough. Preferably, the pilot portion 127 is smaller in diameter than the hole 16; so that the saddle 18 can be moved arcuately and/or longitudinally with respect to the outside surface 22 of the well casing 12 in order to help spread the bonding sealant of the bonded joint 24 uniformly between the well casing 12 and the saddle 18.

The plastic parts of the plastic well assembly 10 may be molded or extruded from any suitable plastic material, such as polyvinyl chloride.

Except for use with artesian wells, an air passage into the casing 12 is needed. This air passage is provided by ribs 128 resting on the top 289 of the casing 12 and by a space 130 between the support plate 26 and the well cap 46.

Unlike previous designs, the support plate 26 covers the entire top of the well casing 12, thereby avoiding accidential or intentional contamination of the well. As can be seen, in order to drop objects such as rocks into the well, it is necessary to remove the plug 47, loosen the adjusting screw 66, and then pull the entire assembly, including the well pipe 43 and the submersible pump (not shown) upwardly. It is unlikely that children would go to such lengths just to hear rocks drop down into the water.

The threaded access opening 30 provides a closable access opening; and the plug 47 provides means for closing the access opening 30. The O-ring 56 provides a sealing means. The locking cam 58 provides a locking means. The retaining pin 60 cooperates with the pin-receiving openings 78 and 80 to provide a retaining means for the locking cam 58; and the screw 66 provides an adjusting means for forcing the locking cam 58 arcuately around the pivot axis 76.

Electrical power for the submersible pump (not shown) is provided by a buried electrical cable (not shown) which proceeds underground to the electrical conduit 48 which also is buried in the ground. The electrical cable (not shown) exits from electrical conduit inside the well cap 46, extends across the well cap 46 to a cable hole 132 in the support plate 26, descends downwardly through the cable hole 132, goes between the plug body 54 and the casing 12, and descends to the submersible pump (not shown). The method for supplying electrical power to the submersible pump is conventional except that the support plate 26 requires the cable hole 132.

Further, as is conventional with the type of well described, the saddle 18 is located below the frost line of the ground; and a water supply pipe (not shown) is attached to the threaded port 20 and extends underground to a house, or other destination.

In addition to providing a plastic well assembly 10, the present invention provides sub-assemblies thereof. The plastic well assembly 10 includes a plastic well adapter assembly 134 which includes the plastic support plate 26, the plastic support tube 32, the plastic adapter plug assembly 38, and which may include the plastic saddle 18. Further, the plastic well assembly 10 includes a smaller sub-assembly which is the plastic adapter plug assembly 38.

Referring now to FIGS. 6–9, in a second preferred embodiment of the present invention, a sealed support plate assembly, or plastic support plate assembly, 136 is provided which makes a water-tight seal with the casing 12 for use with artesian wells.

The sealed support plate assembly 136 includes a plastic support plate 138, a plastic pressure ring 140, a first gasket 142, a plurality of clamping bolts 144, a plurality of washers 146, a plurality of nuts 148, and a second gasket 150.

Optionally, the support plate assembly 136 includes an O-ring, or alternate second gasket, 152 in place of the second gasket 150. As another alternative, the support plate assembly includes a second gasket, or closed-call foam gasket, 154, instead of, or together with, either the gasket 150 or the gasket 152.

Figure 11:
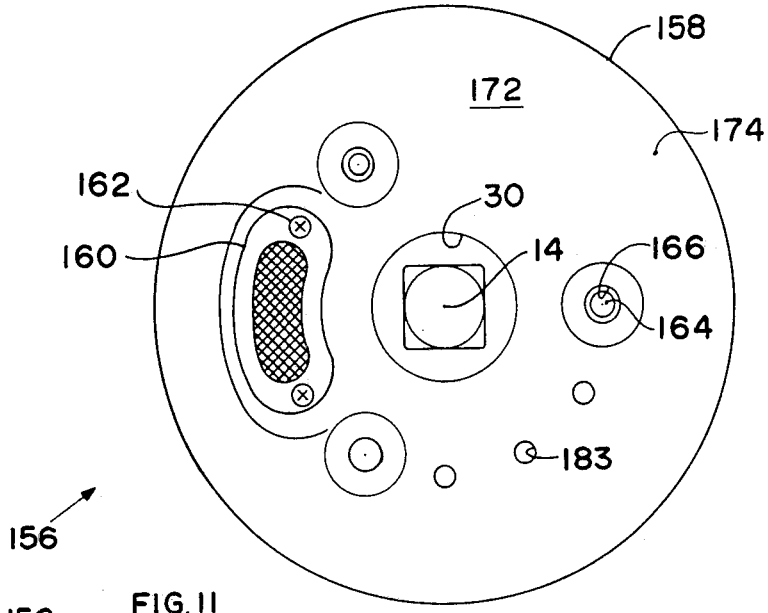
FIG. 11 is a top view of the vented support plate assembly of FIG. 10, taken substantially as shown by view line 11—11 of FIG. 10.
Figure 10:
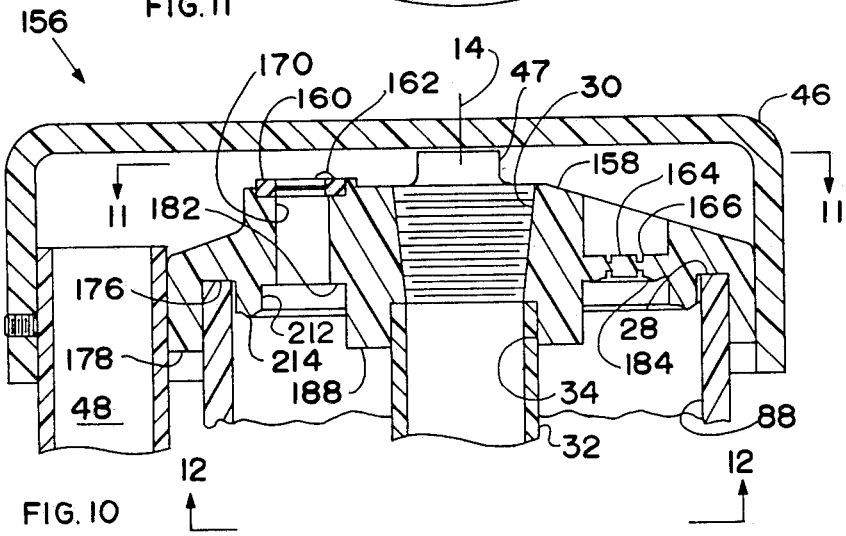
FIG. 10 is a partial cross-section of a third embodiment of the present invention, showing the support plate of FIG. 6 modified for use in a vented support plate assembly.
Figure 12:
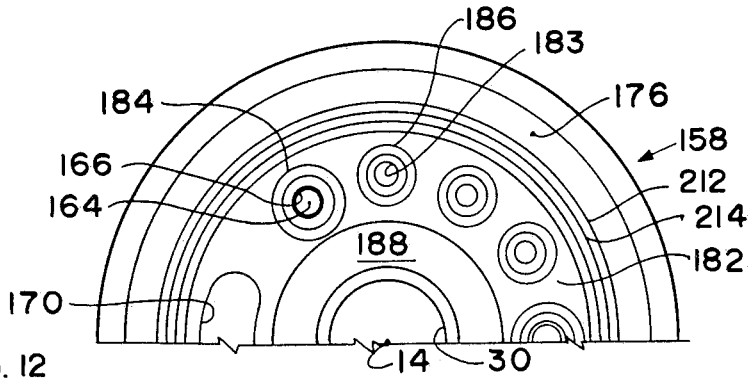
FIG. 12 is a partial bottom view of the support plate for the vented support plate assembly of FIG. 10, taken substantially as shown by view line 12—12 of FIG. 10.

Referring now to FIGS. 10–12, the present invention provides a vented support plate assembly, or plastic support plate assembly, 156 for use with conventional wells, or non-pressurized wells. The vented support plate assembly 156 includes a plastic support plate 158, and a plastic screen plate 160 that is attached to the plastic support plate 158 with drive screws 162.

The plastic support plate 138 for the sealed support plate assembly 136 and the plastic support plate 158 for the vented support plate assembly 156 are made from the same molded part: and the single molded part is modified to be either the support plate 138 or the support plate 158 upon installation at the well-site.

Figure 6:
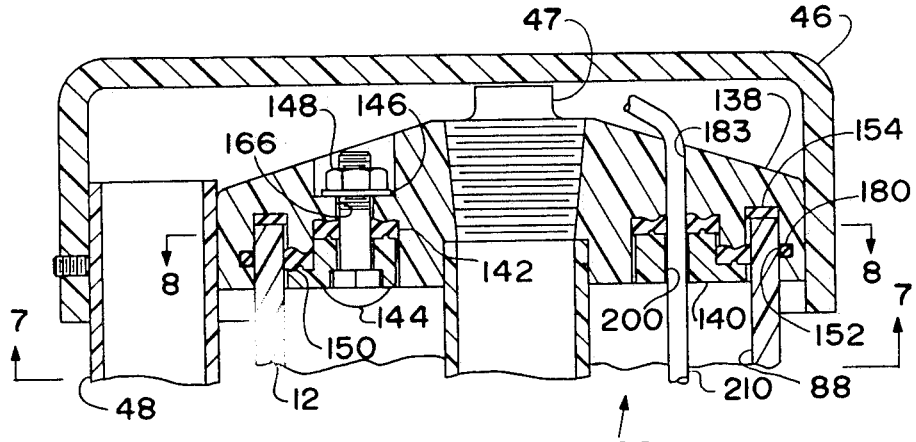
FIG. 6 is a partial cross-section of a second embodiment of the present invention, showing a sealed support plate assembly for use with artesian wells.
Figure 7:
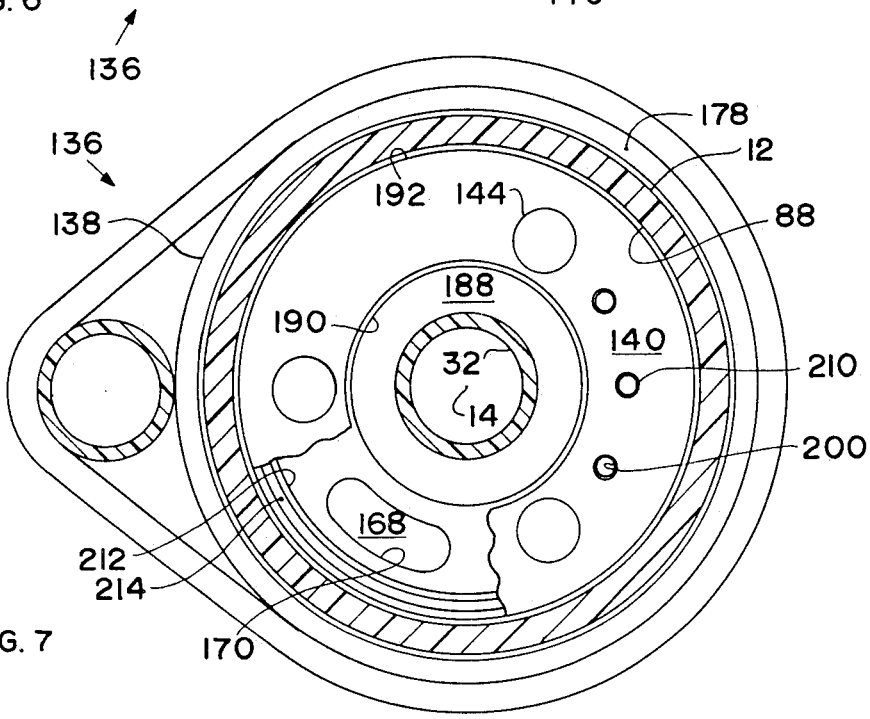
FIG. 7 is a bottom view of the sealed support plate assembly of FIG. 6, taken substantially as shown by view line 7—7 of FIG. 6.

Referring to FIGS. 6–12, the support plate 138 of FIGS. 6 and 7 for the sealed support plate assembly 136 has knock-outs 164 of FIGS. 10–12 removed from bolt openings 166; but a knock-out 168 of FIG. 7 remains in a venting passage 170.

Referring to FIGS. 10–12, the plastic support plate 158 for the vented support plate assembly 156 has the knock-out 168 of FIG. 7 removed from the venting passage 170; but knock-out 164 remains in the bolt openings 166.

Continuing to refer to FIGS. 10–12, the molded plastic part which can be made into the support plate 138 of FIGS. 6 and 7 or into the support plate 158 of FIGS. 10–12 includes a plate portion 172 having a top surface 174 that is generally orthogonal to the casing axis 14, a shoulder portion 176 that is generally orthogonal to the casing axis 14 and that engages the top 28 of the casing 12, or that engages the gasket 154, if such is used, a centering portion, or flange, 178 that is coaxial with the casing axis 14 and that optionally inlcudes an O-ring groove 180 with FIG. 6, a seal-receiving surface 182 that is generally orthogonal to the casing axis 14, three of the bolt openings 166 that extend through the surfaces 174 and 182, and three wire openings 183 that extend through the surfaces 174 and 182.

As best seen in FIG. 12, the plastic part that makes both the support plate 138 and the support plate 158 also includes three larger compression rings 184 that are each coaxial with ones of the bolt openings 166 and that extend downwardly from the seal-receiving surface 182, and three smaller compression rings 186 that are each coaxial with one of the wire openings 183 and that each extend downwardly from the seal-receiving surface 182. As seen in FIG. 10, this same plastic part also includes a threaded access opening 30 that is coaxial with the casing axis 14, a tubular extension 188 that extends downward from the access opening 30 and that includes the socket 34 for receiving the support tube 32, and for bonding the support tube 32 therein.

Figure 9:
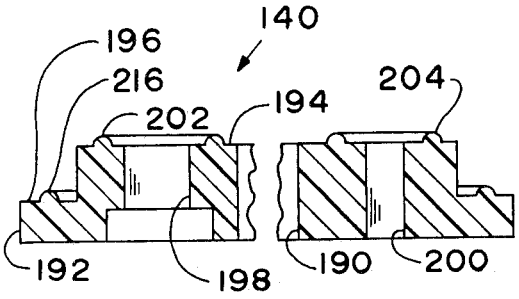
FIG. 9 is a cross-section of two portions of the pressure ring of FIG. 6, taken substantially the same as FIG. 6.
Figure 8:
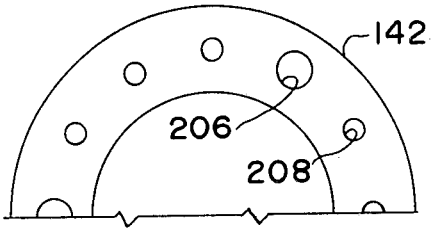
FIG. 8 is a partial plan view of one of the gaskets that is used in the embodiment of FIG. 6, taken substantially as shown by view line 8—8 of FIG. 6.

Referring now to FIGS. 6 and 9, and more particularly to FIGS. 7 and 9, the plastic pressure ring 140 includes an inside diameter 190 that assembles around the tubular extension 188 and that provides a clearance therebetween, an outside diameter 192 that provides a clearance between the pressure ring 140 and the inside surface 88 of the well casing 12, a first seal-receiving surface 194 that is generally orthogonal to the casing axis 14 and that generally corresponds to the seal-receiving surface 182 of the support plates 138 and 158, and a second seal-receiving surface 196 that is disposed radially outward from the seal-receiving surface 194 and that is generally orthogonal to the casing axis 14.

In addition, the pressure ring 140 includes three bolt openings 198, three wire openings 200, three larger compression rings 202, and three smaller compression rings 204, all of which are spaced to match like-named features of the support plates 138 and 158.

Preferably, the first gasket 142 includes three bolt openings 206 and nine wire openings 208 that are spaced so that the gasket 142 will assemble in any of the three positions that are possible with the bolt openings 206.

The larger compression rings, 184, and 202, force the first gasket 142 into sealing engagement with both the clamping bolts 144 and the first sealing-receiving surface 182. In like manner, the smaller compression rings, 186 and 204, force the first gasket 142 into sealing engagement with both electrical wires 210 and the first seal-receiving surface 182.

The support plates 138 and 158 includes a compression flange 212 that projects downwardly between the first seal-receiving surface 182 and the shoulder portion 176. The compression flange 212 includes a compression ring 214 that extends downwardly therefrom, and the second seal-receiving surface 196 of the pressure ring 140 includes a compression ring 216 that extends upwardly therefrom, so that the second gasket 150 is compressed between the compression rings 214 and 216 and is forced outwardly into sealing contact with the inside surface 88 of the well casing 12.

In the embodiment of FIGS. 6–9, the gasket 150 is preferred over the gaskets 152 and 154 because it provides a sure seal as the clamping bolts 144 are tightened. The gasket 150 is lathe cut from a synthetic elastomer of 70 Durometer. Clearance between the well casing 12 and the compression flange 212 is easily sealed by the gasket 150; and excess material of the gasket 150 can be extruded into the clearance between the compression flange 212 and the well casing 12. Thus, the compressibility of the gasket 150, being narrower and more compressible than the gasket 142, provides tolerance for achieving adequate compression on the gasket 150. Further, the larger compression rings, 184 and 202, and the smaller compression rings, 186 and 204, make it unnecessary to compress the gasket 142 except in the areas deformed by the compression rings, 184, 186, 202, and 204. Thus, adequate sealing of all surfaces is achieved without regard to tolerances of the various parts.

The O-rings 152 is preferred for installations where it is believed that water collecting on top of the gasket 150 could present a health problem. Thus, the 0-ring 152 may be used to repalce the gasket 150, or it can be used in addition to the gasket 150.

In like manner, the gasket 154 may be used in place of, or in addition to either or both of the other gaskets, 150 and 152. The gasket 154 is formed of a closed cell foam of a synthetic elastomer; and the weight of the well 10 provides the force that is required to deform the gasket 154 into sealing engagement with the shoulder portion 176 and the top 28 of the well casing 12.

In summary, the second embodiment of FIGS. 6–9 and the third embodiment of FIGS. 9–11 both include a support plate, 138 or 158, that is field-adaptable from a single molded part. The sealed support plate assembly 136 includes means for sealing that is sure and sanitary; and the vented support plate assembly 156 provides a screened vent 160 to prevent contamination from living creatures or other impurities. The well cap 46 and the conduit 48 protect the electrical wires 120 for both the sealed support plate assembly 136 and the vented support plate assembly 158. The well cap 46 also prevents contaminants from dropping onto the screen plate 160.

The entire well 10 is formed from plastic materials, including the support plates, 138 and 158, the plug body 54, the locking cam 58, and the saddle 18; so that long life, freedom from corrosion, and economy are all achieved by the present invention.

While specific apparatus and method have been disclosed in the preceding description, and while part numbers have been inserted parenthetically into the claims to facilitate understanding of the claims, it should be understood that these specifics have been given for the purpose of disclosing the principles of the present invention and that many variations thereof will become apparent to those who are versed in the art. Therefore, the scope of the present invention is to be determined by the appended claims, and without any limitation by the part numbers inserted parenthetically in the claims.

INDUSTRIAL APPLICABILITY

The present invention is applicable to water wells for use in providing water in homes and on lawns, for use in industry, for irrigation of farmland or drinking water for livestock, and for providing water commercially.

What is claimed is:

1. An adapter plub assembly (38) for making fluid communication between a well pipe (43) and a hole (16) that is disposed transversely through a well casing (12) having a longitudinally-disposed casing axis (14), which adapter plug assembly comprises:

a plug body (54) having a cylindrically-shaped surface (98) that is disposed coaxially with said casing axis, having a top (96), having a bottom (102) with an inlet port (104) therein, and having an outlet port (100) that communicates with said inlet port and that opens through said cylindrically-shaped surface;

sealing means (56) being disposed circumferentially around said outlet port, for providing a fluid seal between said plug body and said casing that circumscribes said outlet port and said hole in said casing;

locking means, comprising a recess (62) in said plug body, comprising a locking cam (58) that is disposed in said recess, and comprising an arcuately-shaped surface (72 or 74), guiding said locking cam in an arcuately-shaped path around a pivot axis (76), for engaging said casing distal from said outlet port, and for forcing said plug body toward said hole in said casing, whereby said sealing means is forced into sealing engagement with said casing;

retaining means, comprising a retaining pin (60) that is disposed coaxially with said pivot axis, for retaining said locking cam in said recess, and for permitting said locking cam to slide around said arcuately-shaped path while generally rotating around said pivot axis; and adjusting means (66) for forcing said locking cam to slide around said arcuately shaped path.

2. An adapter plug assembly (38) as claimed in claim 1 in which said retaining means comprises a first pin-receiving opening (78) in said plug body (54) and a second pin-receiving opening (80) in said locking cam (58); and said adapter plug assembly comprises means, including one (78 or 80) of said pin receiving openings being larger in diameter than said retaining pin, for permitting said locking cam to move transversely with respect to said pivot axis (76), and for preventing stress from being transmitted from said arcuately-shaped surface (72 or 74) to said retaining pin or to either of said pin openings.

3. An adapter plug assembly (38) as claimed in claim 2 in which said locking cam comprises a plastic locking cam (58).

4. An adapter plug assembly (38) as claimed in claim 3 in which said adapter plug assembly includes means, comprising another arcuately-shaped surface (81) that is disposed coaxially with said pivot axis (76), for vertically restraining said locking cam (58).

5. An adapter plug assembly (38) as claimed in claim 1 in which said adapter plug assembly includes means, comprising said locking cam (58) engaging said plug body (54), for vertically restraining said locking cam.

6. An adapter plug assembly (38) as claimed in claim 5 in which said retaining means comprises a first pin-receiving opening (78) in said plug body (54) and a second pin-receiving opening (80) in said locking cam (58); and said adapter plug assembly comprises means, including one (78 or 80) of said pin receiving openings being significantly larger in diameter than said retaining pin, for permitting said locking cam to move transversely with respect to said pivot axis (76), and for preventing stress from being transmitted from said arcuately-shaped surface (72 or 74) to said retaining pin or to either of said pin openings.

7. An adapter plug assembly (38) as claimed in claim 1 in which said retaining means comprises a first pin-receiving opening (78) in said plug body (54) and a second pin-receiving opening (80) in said locking cam (58);

said adapter plug assembly comprises means, including one (78 or 80) of said pin receiving openings being larger in diameter than said retaining pin, for permitting said locking cam to move transversely with respect to said pivot axis (76) and for preventing stress from being transmitted from said arcuately-shaped surface (72 or 74) to said retaining pin or to either of said pin openings.

said adapter plug assembly includes means, comprising another arcuately-shaped surface (81) that is disposed coaxially with said pivot axis (76), for vertically restraining said locking cam (58);

said adjusting means comprises an adjusting screw (66) that is disposed substantially parallel to said casing axis (14); and said pivot axis (76) is disposed substantially orthogonal to said casing axis.

8. A well adapter assembly (134) for supporting a well pipe (43) inside a casing (12) having a longitudinally-disposed casing axis (14), and for making fluid communication between said well pipe and a hole (16) that is disposed transversely through said casing, which well adapter comprises:

a plug body (54) having a cylindrically-shaped surface (98) that is disposed coaxially with said casing axis, having a top (96), having a bottom (102) with an inlet port (104) therein, and having an outlet port (100) that communicates with said inlet port and that opens through said cylindrically-shaped surface;

sealing means (56), being disposed circumferentially around said outlet port, for providing a fluid seal between said plug body and said casing that circumscribes said outlet port and said hole in said casing;

locking means, comprising a recess (62) in said plug body (54), comprising a locking cam (58) that is disposed in said recess, and comprising an arcuately-shaped surface (72 or 74), for guiding said locking cam in an arcuately-shaped path around a pivot axis (76), for engaging said casing distal from said outlet port, and for forcing said plug body toward said hole in said casing, whereby said sealing means is forced into sealing engagement with said casing;

retaining means, comprising a retaining pin (60) that is disposed coaxially with said pivot axis, for retaining said locking cam in said recess, and for permitting said locking cam to slide around said arcuately-shaped path while generally rotating around said pivot axis;

adjusting means (66) for forcing said locking cam to slide around said arcuately-shaped path;

support plate means (26, 138, or 158) for engaging said casing;

support tube means (32), being disposed circumferentially around said casing axis, and being operatively attached to both said support plate means and said plug body, for supporting said plug body; and saddle means (18), being disposed outside said casing and being operatively secured thereto, for communicating with said hole in said casing and with said outlet port in said plug body.

9. A well adapter assembly (134) as claimed in claim 8 in which said retaining means comprises a first pin-receiving opening (78) in said plug body (54) and a second pin-receiving opening (80) in said locking camp (58); and said adapter plug assembly comprises means, comprising permitting said locking cam to move transversely with respect to said pivot axis (76), for preventing stress from being transmitted from said arcuately-shaped surface (72 or 74) to said pin or to either of said pin openings.

10. A well adapter assembly (134) as claimed in claim 9 in which said locking means includes means, comprising said locking cam (58) engaging said plug body (54), for vertically restraining said locking cam.

11. A well adapter assembly (134) as claimed in claim 10 in which said plug body (54) is molded of a plastic material; and said locking cam comprises a plastic locking cam (58).

12. A well adapter assembly (134) as claimed in claim 8 in which said locking means includes means, comprising said locking cam (58) engaging said plug body (54), for vertically restraining said locking cam.

13. A well adapter assembly (134) as claimed in claim 12 in which said arcuately-shaped surface (72 or 74) of said locking means comprises an arcuately-shaped surface (72) on said locking cam (58); and said means for vertically restraining, and said engaging of said locking cam (58) with said plug body (54), comprises a second arcuately-shaped surface on said locking cam that engages said plug body.

14. A well adapter assembly (134) as claimed in claim 13 in which said well adapter assembly comprises means, comprising permitting said locking cam (58) to move transversely with respect to said retaining pin (60), for preventing stress from being transferred from the first said arcuately-shaped surface (72) to said retaining pin (60).

15. An adapter plug assembly (38) for making fluid communication between a well pipe (43) that is disposed inside a well casing (12) having a longitudinal axis (14), and a hole (16) that is disposed orthogonally through said well casing, which adapter plug assembly comprises:

plug body means (54), having a cylindrically-shaped surface (98), having a bottom (102) that is generally orthogonal to said cylindrically-shaped surface and that includes an inlet port (104), and having an outlet port (100) that communicates with said inlet port and that opens through said cylindrically-shaped surface, for insertion into said well casing with said cylindrically-shaped surface generally coaxial with said longitudinal axis, and for generally aligning said outlet port with said hole in said well casing;

sealing ring means (56), being disposed circumferentially around said outlet port, for providing a fluid seal between said outlet port and said hole in said well casing;

locking means, comprising a locking cam (58) that includes a first arcuately-shaped surface (72), and comprising a second arcuately-shaped surface (74) of said plug body means that slidably receives said first arcuately-shaped surface, for guiding said locking cam in pivotal movement around a pivot axis (76) that is orthogonal to said longitudinal axis and that intercepts both said locking cam and said plug body means, for engaging said casing distal from said outlet port, and for forcing said plug body means toward said hole in said casing, whereby said sealing means is forced into sealing engagement with said casing;

retaining means, comprising a retaining pin (60), for retaining said locking cam in said recess, and for permitting said locking cam to pivot around said pivot axis; and adjusting means, being disposed substantially parallel to said longitudinal axis (14), for forcing said cam to slide around said arcuately-shaped path while generally rotating around said pivot axis.

16. An adapter plug assembly (38) as claimed in claim 15 in which said adapter plug assembly includes avoiding means, for preventing stress between said arcuately-shaped surfaces from being applied to said retaining pin as said arcuately-shaped surfaces guide said locking cam in pivotal movement around said pivot axis.

17. An adapter plug assembly (38) as claimed in claim 16 in which said retaining means comprises said retaining pin (60) engaging both an opening (78) in said plug body means (54) and an opening (80) in said locking cam (58); and said avoiding means comprises one of said openings being larger in diameter that said retaining pin.

18. An adapter plug assembly (38) as claimed in claim 16 in which said adapter plug assembly includes restraining means, comprising said locking cam (58) engaging said plug body means (54), for vertically restraining said locking cam, and for permitting said locking cam to pivot around said pivot axis (76).

19. An adapter plug assembly (38) as claimed in claim 18 in which said locking cam (58) includes a third arcuately shaped surface (81) that is disposed coaxially around said pivot axis (76); and said restraining means, and said locking cam engaging said plug body means (54), comprises said third arcuately-shaped surface engaging said plug body means.

20. An adapter plug assembly (38) as claimed in claim 19 in which said first arcuately shaped surface (72) has a first radius (73); and said third arcuately shaped surface (81) has a second radius (85) that is less than one-half of said first radius.

21. An adapter plug assembly (38) as claimed in claim 16 in which said retaining means comprises said retaining pin (60) engaging both an opening (78) in said plug body means (54) and an opening (80) in said locking cam (58); and said avoiding means comprises one of said openings being significantly larger in diameter than said retaining pin; and said adapter plug assembly includes restraining means, comprising said locking cam (58) engaging said plug body means (54), for vertically restraining said locking cam, and for permitting said locking cam to pivot around said pivot axis (76).

22. An adapter plug assembly (38) as claimed in claim 21 in which said first arcuately-shaped surface (72) has a first radius (73);

said locking cam (58) includes a third arcuately shaped surface (81) that is disposed coaxially around said pivot axis (76), and that has a radius (85) which is less than one-half of said first radius; and said restraining means, and said locking cam engaging said plug body means (54), comprises said third arcuately-shaped surface engaging said plug body means.

23. An adapter plug assembly (38) as claimed in claim 15 in which said adapter plug assembly includes restraining means, comprising said locking cam (58) engaging said plug body means (54), for vertically restraining said locking cam, and for permitting said locking cam to pivot around said pivot axis (76).

24. An adapter plug assembly (38) as claimed in claim 23 in which said locking cam (58) includes a third arcuately shaped surface (81) that is disposed coaxially around said pivot axis (76); and said restraining means, and said locking cam engaging said plug body means (54), comprise said third arcuately-shaped surface engaging said plug body means.

25. An adapter plug assembly (38) as claimed in claim 24 in which said first arcuately shaped surface (72) has a first radius (73); and said third arcuately shaped surface (81) has a second radius (85) that is less than one-half of said first radius.

* * * * *

UNITED STATES PATENT AND TRADEMARK OFFICE

CERTIFICATE OF CORRECTION

PATENT NO. : 4,785,881

DATED : November 22, 1988

INVENTOR(S) : Cecil H. Paulus

It is certified that error appears in the above-identified patent and that said Letters Patent is hereby corrected as shown below:

In column 2, "wall" should be --well-- in line 7; "surface guide" should be --surfaces guide-- in line 18; and "on the cam" should be --of the cam-- in line 23. In column 3, "insolated" should be --isolated-- in lines 25 and 26. In column 5, "volume for" should be --volume of-- in line 43; and "56 at it" should be --56 as it-- in line 44. In column 6, "289" should be --28-- in line 44. In column 7, --the-- should be inserted between "from" and "electrical" in line 2; and "closed-call" should be --closed-cell-- in line 38. In column 8, "180 with FIG. 6" should be --180 of FIG. 6-- in line 6; and "sealing-receiving" should be --seal-receiving-- in line 49. In column 10, --for-- should be inserted between "(72 or 74)," and "guiding" in line 16. In column 11, "openings." should be --openings;-- in line 13. In column 12, "camp" should be --cam-- in line 4.

Signed and Sealed this

Ninth Day of May, 1989

*Attest:*

DONALD J. QUIGG

*Attesting Officer*

*Commissioner of Patents and Trademarks*